US005129641A

United States Patent [19]

Long

[11] Patent Number: 5,129,641

[45] Date of Patent: Jul. 14, 1992

[54] MULTIPLE STAGE DISPENSER

[76] Inventor: John A. Long, 51 Lamont Avenue, Scarbough, Ontario, Canada, M1S 1A8

[21] Appl. No.: 653,737

[22] Filed: Feb. 11, 1991

Related U.S. Application Data

[63] Continuation of Ser. No. 449,457, Dec. 12, 1989, abandoned, which is a continuation of Ser. No. 196,477, May 20, 1988, abandoned.

[51] Int. Cl.[5] ..... B65H 5/22

[52] U.S. Cl. ..... 271/6; 271/10; 271/35; 271/111; 271/199; 271/265; 271/270; 271/202; 198/460; 198/572

[58] Field of Search ..... 271/111, 270, 202

[56] References Cited

U.S. PATENT DOCUMENTS 3,981,493 9/1976 Klappenecker et al. ..... 271/114 X 4,451,027 5/1984 Alper ..... 271/10

FOREIGN PATENT DOCUMENTS 0095858 12/1983 European Pat. Off. ..... 198/460

385859 7/1973 U.S.S.R. ..... 198/460

*Primary Examiner*—H. Grant Skaggs

*Assistant Examiner*—Carol Lynn Druzbick

*Attorney, Agent, or Firm*—Smart & Biggar

[57] ABSTRACT

A method and apparatus for delivering cards or like paper stock fed singly from a stack of the cards to a demand location for dispensing in sequence, in which each card fed from the stack is advanced through a plurality of stages of a conveyor, each stage being independently operable, each stage and all preceding stages and the stack feeder being actuable when no card is present at that stage, the leading stage being also operable to deliver a card on demand, the cards being feed at a higher rate than the dispensing rate.

6 Claims, 3 Drawing Sheets

MULTIPLE STAGE DISPENSER

This application is a continuation of application Ser. No. 449,457, filed Dec. 12, 1989, now abandoned, which is a continuation of application Ser. No. 196,477, filed May 20, 1988, now abandoned.

Field of the Invention

This invention relates to the high speed feeding of cards or like paper material from a stack of such cards to a dispensing station..

BACKGROUND OF THE INVENTION

In my U.S. Pat. No. 3,908,983 issued Sept. 30, 1975 I described a device for feeding single blank cards at high speed into a machine for scoring, folding, stacking or otherwise handling such cards. In the operation of that device a stack of cards is placed between a guide bar and a retainer plate which hold the stack sloping downwardly in a forward direction with the lower cards of the stack being fanned forwardly above an endless belt. As the belt moves, the lowest card of the stack is drawn through the gap between the belt and a friction wheel which rotates slowly to allow the cards to move singly through the gap. The belt and friction wheel are driven by the same motor with suitable gear reduction.

In my later U.S. Pat. No. 4,651,983 issued Mar. 24, 1987 I describe a device for controlling the rate of issuance of the cards in my U.S. Pat. No. 3,908,983.

In operation the above-mentioned devices will misfeed on occasion, i.e. a gap will appear between two sequentially fed cards.

It is an object of the present invention to provide a method and device whereby the incidence of misfeeding of cards in a card feeding machine is reduced.

SUMMARY OF THE INVENTION

Essentially the invention consists of a method and apparatus for delivering cards or like paper stock fed singly from a stack of the cards to a demand location for dispensing in sequence, in which of a conveyor, each stage being independently operable, each stage and all preceding stages and the stack feeder being actuable when no card is present at that stage, the leading stage being also operable to deliver a card on demand, the cards being fed at a higher rate than the dispensing rate.

BRIEF DESCRIPTION OF THE DRAWINGS

An example embodiment of the invention is shown in the accompanying drawings in which.

DESCRIPTION OF PREFERRED EMBODIMENT

Figure 1:
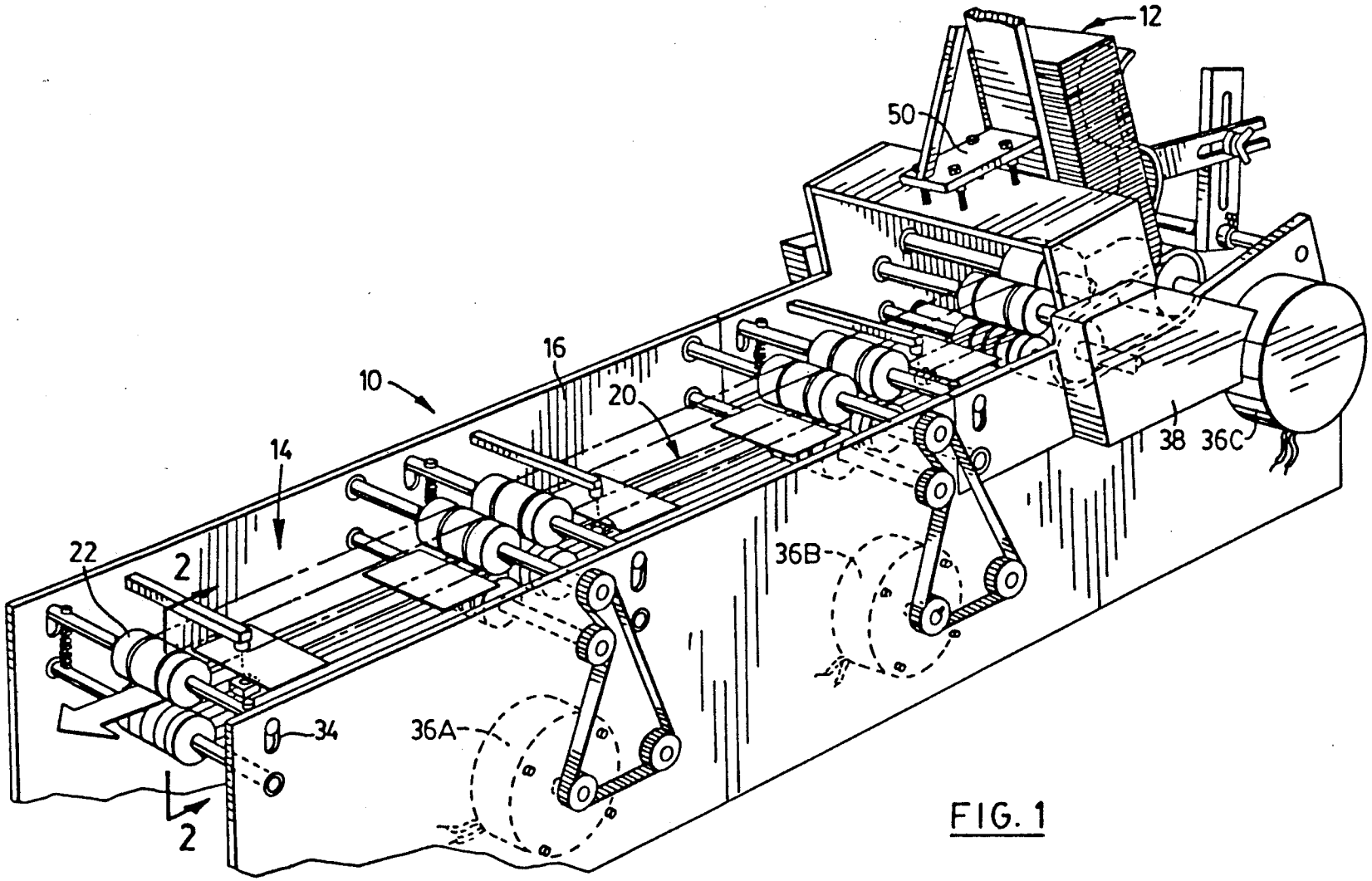
FIG. 1 is a perspective view of a dispenser.

The example embodiment shown in the drawings consists of a dispenser 10 which comprises a feeder 12 and a movable platform or conveyor 14, both mounted on a fixed frame 16.

Figure 2:
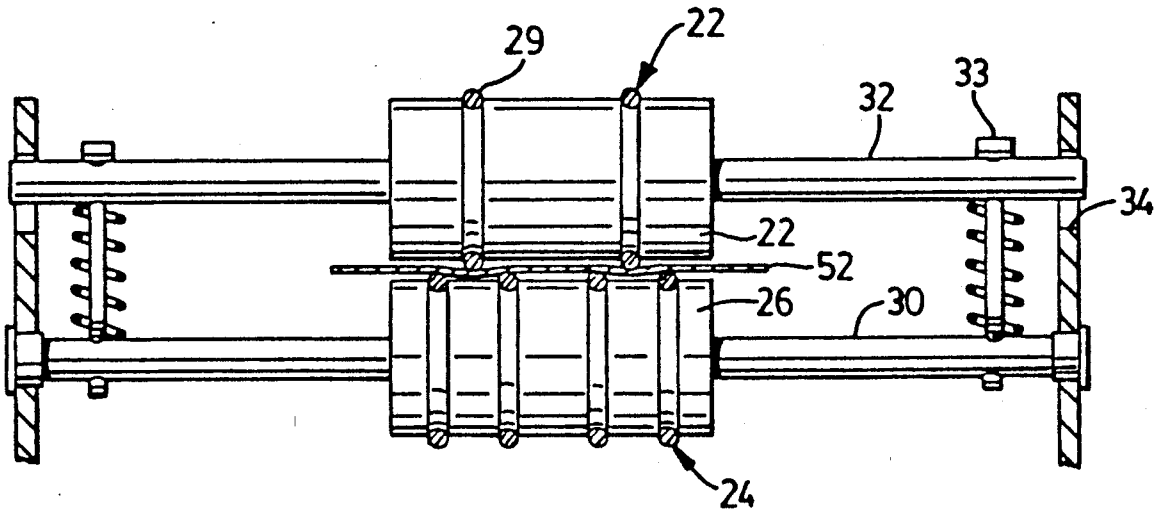
FIG. 2 is a cross-sectional view taken along line 2—2 of FIG. 1.
Figure 4:
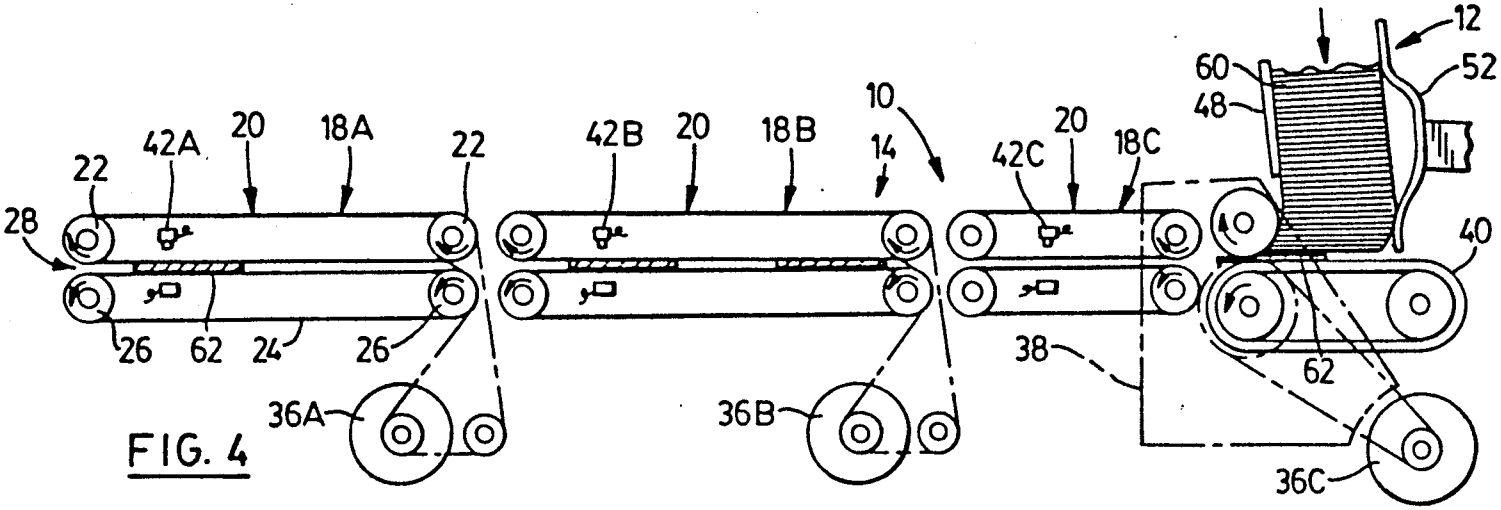
FIG. 4 is a view similar to FIG. 3 showing the operation of the device with a misfeed.

Feeder 12 is described in my aforementioned U.S. Pat. No. 3,908,983. Conveyor 14 consists of three stages 18A, 18B and 18C; stage 18A serving as a demand location for dispensing cards to a subsequent system not shown. Each stage 18 consists of an upper endless belt unit 20 carried by a pair of rollers 22 and a lower endless belt unit 24 carried by a pair of rollers 26, the belts being spaced one from the other to form a gap 28. In the example embodiment belt unit 24 has a plurality of parallel bands 29 but other means such as a vacuum belt could be used. As seen in FIG. 2, rollers 22 and 26 are mounted on shafts 30 and 32 respectively which are rotatable on frame 16 and are interconnected by axle proximity adjustment screws 32, shaft 30 being movable radially at each end in slots 34 in frame 16 to adjust the width of gap 28. Belts 20 and 24 of stage 18A are chain driven by a drive motor 36A and belts 20 and 24 of stage 18B are chain driven in the same manner by a drive motor 36B. Belts 20 and 24 of stage 18C are driven through a gear train 38 from a chain drive 36C which operates an endless movable feeder platform 40 of feeder 12. Each stage 18 has a photoelectric unit 42 bridging gap 28 between belts 20 and 24 adjacent the forward end of the stage and each photocell unit is electrically connected independently to its associated drive motor 36 of the same stage, as seen in FIG. 4 of the Drawings. Drive motors 36A, 36B and 36C are electrically interconnected whereby drive motors 36B and 36C are slaves to drive motor 36A and drive motor 36C is also slave to drive motor 36B.

Feeder 12 consists of movable feeder platform 40 and a rotatable friction wheel 44 mounted on frame 16 above the platform with a gap 46 therebetween. A guide bar 48, mounted on a forwardly projecting plate 50, is located above platform 40 and tangential to friction wheel 44 and an adjustable retainer bracket 52, spaced behind guide bar 48, is also mounted on frame 16.

Figure 3:
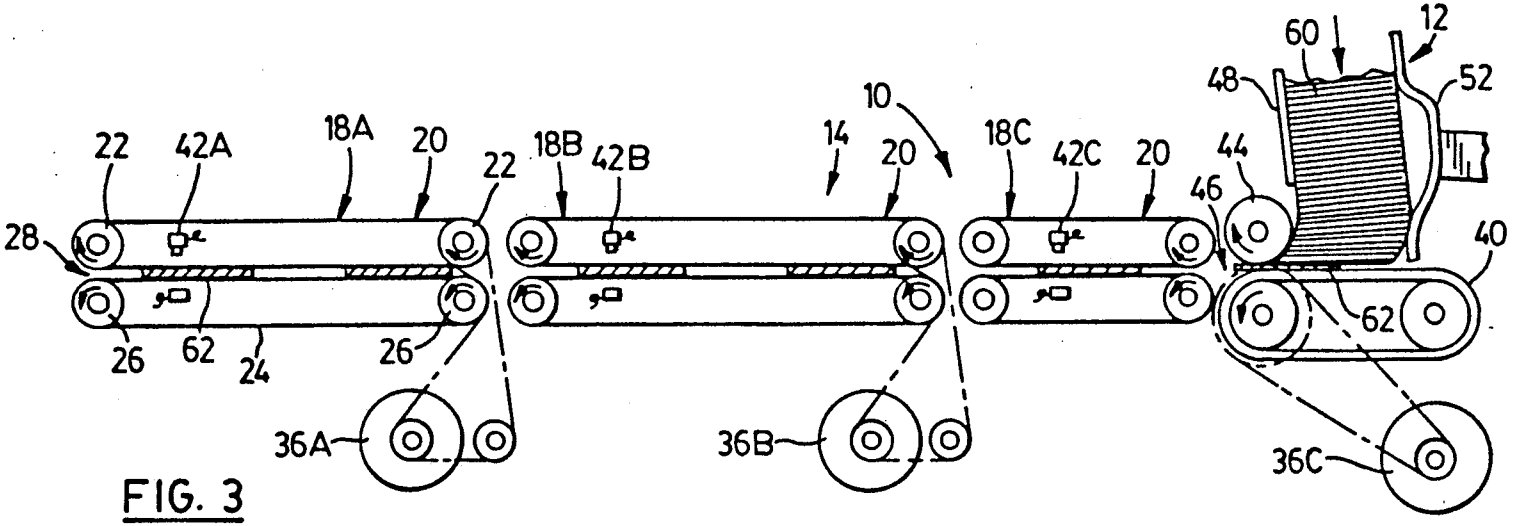
FIG. 3 is a diagrammatic side elevational view of the device of FIG. 1 in operation.

In the operation of the device, a stack 60 of cards is placed between guide bar 48 and retainer bracket 52 to rest on platform 40. As platform 40 is moved, the bottom or first card 62 in stack 60 advances through gap 46 and into gap 28 of stage 18C of conveyor 14, followed at a uniformly predetermined distance by the second and subsequent cards in the stack, as seen in FIG. 3 of the drawings.

When card 62 reaches the position in stage 18A in the path of photocell unit 42A and the demand location is satisfied, i.e. when conveyor 14 is capable of delivering a card on demand then a signal from the photocell stops drive motor 36A However, drive motor 36B continues to operate until a card 62 reaches photocell unit 42B to stop drive motor 36B. Notwithstanding the mode of stages 18A and 18B (moving or stationary), drive motor 36C continues to drive feeder 12 and stage 18C until stopped by the interposition of a card 52 in the path of photocell unit 42C. Also the feed rate of cards from drive feeder 12 always exceeds the output expected from demand location 18A.

From this manner of operation it will be seen that the dispensing of cards in timed sequence from a demand location is enhanced because it allows cards to advance and fill gaps in the feed sequence while the leading card is temporarily resting at the demand location.

In the example embodiment shown in the drawings an additional card 62 is shown between photocell units 42A and 42B and also between units 42B and 42C but this has no effect on the operation of the device, merely providing additional cards for the demand location.

The term "card" used herein includes any flat paper stock or like products.

I claim:

1. In a method of delivering cards or like paper stock to a demand location for dispensing in timed sequence therefrom, the steps of:

(1) feeding cards singly from a bottom stack feeder through a plurality of sequential conveyor stage to a final stage constituting a demand location;

(2) operating each stage of the conveyor independently, the stack feeder and the first stage of the conveyor being operated together;

(3) actuating each stage of the conveyor when no card is present at a predetermined position in that stage and simultaneously actuating each preceding stage; and (4) operating the final stage also to dispense a card in timed sequence therefrom, the feed rate of cards from the stack feeder being higher than the rate of dispensing cards from the final stage.

2. A method as claimed in claim 1 including the step of sensing photoelectrically the presence of a card at said predetermined position on each stage.

3. A method as claimed in claim 2 in which the photoelectric sensing actuates that stage and all preceding stages and the stack feeder.

4. An apparatus for delivering cards or like paper stock to a demand location for dispensing in timed sequence therefrom, comprising:

a bottom stack feeder;

conveyor means having an input end to receive cards fed from the stack feeder and an output end constituting a demand location, the conveyor means comprising a plurality of sequential stages each having independently operable drive means, the stack feeder being operable with the first stage of the conveyor means, to feed the cards at a rate higher than the rate of dispensing the cards from the demand location; and means to sense the presence of a card at a predetermined position in each stage and simultaneously to actuate the drive means thereof and the drive means of all the preceding stages together with the stack feeder when a card is not present at said predetermined position.

5. Apparatus as claimed in claim 4 in which the means to sense the presence of a card at each stage comprises photoelectric means.

6. Apparatus as claimed in claim 5 in which the drive means comprises an independent electric drive motor associated with each stage and with the stack feeder, the photoelectric means at each stage being electrically connected to the drive motor at said stage and to the drive motors of each preceding stage and the stack feeder.

* * * * *